US006844863B2

(12) United States Patent
Judd et al.

(10) Patent No.: US 6,844,863 B2
(45) Date of Patent: Jan. 18, 2005

(54) ACTIVE ANTENNA WITH INTERLEAVED ARRAYS OF ANTENNA ELEMENTS

(75) Inventors: Mano D. Judd, Rockwall, TX (US); Thomas A. Bachman, II, Darlington, MD (US)

(73) Assignee: Andrew Corporation, Orland Park, IL (US)

( * ) Notice: Subject to any disclaimer, the term of this patent is extended or adjusted under 35 U.S.C. 154(b) by 312 days.

(21) Appl. No.: 10/256,860

(22) Filed: Sep. 27, 2002

(65) Prior Publication Data

US 2004/0066333 A1 Apr. 8, 2004

(51) Int. Cl.[7] ..... H01Q 1/38

(52) U.S. Cl. ..... 343/853; 343/700 MS; 455/91; 455/101; 455/129

(58) Field of Search ..... 343/700 MS, 810, 343/844, 853; 342/372, 373, 374; 455/91, 101, 103, 104, 129, 273

(56) References Cited

U.S. PATENT DOCUMENTS

| | | | | |
|---|---|---|---|---|
| 4,124,852 | A | 11/1978 | Steudel | 343/854 |
| 4,246,585 | A | 1/1981 | Mailloux | 343/854 |
| 4,360,813 | A | 11/1982 | Fitzsimmons | 343/100 R |

(List continued on next page.)

FOREIGN PATENT DOCUMENTS

| | | | | |
|---|---|---|---|---|
| EP | 0 551 556 | A1 | 7/1993 | H01P/5/08 |
| EP | 0 639 035 | A1 | 2/1995 | H04Q/7/36 |
| EP | 0 713 261 | A1 | 5/1996 | H01Q/3/26 |
| EP | 0 878 974 | A1 | 11/1998 | H04Q/7/22 |
| EP | 0 994 567 | A2 | 4/2000 | H04B/1/00 |
| EP | 1 111 821 | A2 | 6/2001 | H04B/17/00 |
| GB | 2 286 749 | A | 8/1995 | H04B/7/08 |
| JP | 08-102618 | | 4/1996 | H01Q/25/00 |
| JP | 11-330838 | | 11/1999 | H01Q/3/26 |
| WO | WO 95/26116 | | 9/1995 | H04Q/7/36 |
| WO | WO 95/34102 | | 12/1995 | H01Q/1/38 |
| WO | WO 97/44914 | | 11/1997 | H04B/1/50 |
| WO | WO 98/11626 | | 3/1998 | H01Q/23/00 |
| WO | WO 98/39851 | | 9/1998 | H04B/1/38 |
| WO | WO 98/09372 | | 1/1999 | H04B/1/04 |
| WO | WO 98/50981 | | 4/2001 | H01Q/3/26 |

OTHER PUBLICATIONS

Song, H.J. and Blalkowski, M.E., *A Multilayer Microstrip Patch Antenna Subarray Design Using CAD*, Microwave Journal, Mar. 1997, pp. 22–34 (8 pages).

Levine, E., Malamud, G., Shtrikman, S., and Treves, D., *A study Microstrip Array Antennas with the Feed Network*, IEEE Trans. Antennas Propagation, vol. 37, No. 4, Apr. 1989, pp. 426–434 (8 pages).

Herd, J.S., *Modeling of Wideband Proximity Coupled Microstrip Array Elements*, Electronic Letters, vol. 2 No. 16, Aug. 1990, pp. 1282–1284 (3 pages).

Hall, P.S. and Hall, C.M., *Coplanar Corporate Feed Effects in Microstrip Patch Array Design*, Proc. IEEE, vol. 135, pt. H, Jun. 1988, p. 180–186 (7 pages).

Zurcher, J.F., *The SSFIP: A Global Concept for High–Performance Broadband Planar Antennas*, Electronic Letters, vol. 24, No. 23, Nov. 1988, p. 1433–1435 (4 pages).

Zurcher, J.F. and Gardiol, F.E., *The SSFIP Principle: Broadband Patch Antennas*, Artech House, 1995, Chapter 3, pp. 45–60 (17 pages).

Song, H.J. Bialkowski, M.E., *Ku–Band 16×16 Planar Array with Aperture–Coupled Microstrip–Patch Elements*, IEEE Antennas and Propagation Magazine, vol. 40, No. 5, Oct. 1998, pp. 25–29 (5 pages).

*Primary Examiner*—Tan Ho

(74) *Attorney, Agent, or Firm*—Wood, Herron & Evans, L.L.P.

(57) ABSTRACT

An antenna has multiple arrays of radiating elements and includes a plurality of single channel power amplifiers, with each amplifier electrically connected with an array. The radiating elements of the arrays are interleaved so that radiation from the arrays combines at a distance from the antenna.

22 Claims, 2 Drawing Sheets

U.S. PATENT DOCUMENTS 4,566,013 A 1/1986 Steinberg et al. ..... 343/372
4,607,389 A 8/1986 Halgrimson ..... 455/11
4,614,947 A 9/1986 Rammos ..... 343/778
4,689,631 A 8/1987 Gans et al. ..... 343/781 R
4,825,172 A 4/1989 Thompson ..... 330/124 R
4,849,763 A 7/1989 DuFort ..... 342/372
4,890,110 A 12/1989 Kuwahara ..... 342/35
4,994,813 A 2/1991 Shiramatsu et al. ..... 342/360
5,034,752 A 7/1991 Pourailly et al. ..... 342/373
5,038,150 A 8/1991 Bains ..... 342/373
5,061,939 A 10/1991 Nakase ..... 343/700 MS
5,206,604 A 4/1993 Vaninetti ..... 330/124 R
5,230,080 A 7/1993 Fabre et al. ..... 455/15
5,247,310 A 9/1993 Waters ..... 342/368
5,248,980 A 9/1993 Raguenet ..... 342/354
5,270,721 A 12/1993 Tsukamoto et al. .. 343/700 MS
5,280,297 A 1/1994 Profera, Jr. ..... 343/754
5,327,150 A 7/1994 Cherrette ..... 343/77.1
5,355,143 A 10/1994 Zürcher et al. ..... 343/700 MS
5,379,455 A 1/1995 Koschek ..... 455/273
5,412,414 A 5/1995 Ast et al. ..... 342/174
5,437,052 A 7/1995 Hemmie et al. ..... 455/5.1
5,457,557 A 10/1995 Zarem et al. ..... 359/121
5,513,176 A 4/1996 Dean et al. ..... 370/18
5,548,813 A 8/1996 Charas et al. ..... 455/33.3
5,554,865 A 9/1996 Larson ..... 257/275
5,568,160 A 10/1996 Collins ..... 343/778
5,596,329 A 1/1997 Searle et al. ..... 342/374
5,604,462 A 2/1997 Gans et al. ..... 330/124 R
5,610,510 A 3/1997 Boone et al. ..... 324/95
5,619,210 A 4/1997 Dent ..... 342/352
5,621,422 A 4/1997 Wang ..... 343/895
5,623,269 A 4/1997 Hirshfield et al. ..... 342/354
5,644,316 A 7/1997 Lewis et al. ..... 342/174
5,644,622 A 7/1997 Russell et al. ..... 455/422
5,646,631 A 7/1997 Arntz ..... 342/373
5,657,374 A 8/1997 Russell et al. ..... 370/328
5,659,322 A 8/1997 Caille ..... 342/188
5,680,142 A 10/1997 Smith et al. ..... 342/372
5,710,804 A 1/1998 Bhame et al. ..... 379/58
5,714,957 A 2/1998 Searle et al. ..... 342/374
5,724,666 A 3/1998 Dent ..... 455/562
5,745,841 A 4/1998 Reudink et al. ..... 455/62
5,751,250 A 5/1998 Arntz ..... 342/373
5,754,139 A 5/1998 Turcotte et al. ..... 342/372
5,758,287 A 5/1998 Lee et al. ..... 455/450
5,770,970 A 6/1998 Ikeda et al. ..... 330/286
5,771,017 A 6/1998 Dean et al. ..... 33/286
5,774,666 A 6/1998 Portuesi ..... 395/200.48
5,784,031 A 7/1998 Weiss et al. ..... 342/373
5,802,173 A 9/1998 Hamilton-Piercy et al. ..... 379/56.2
5,809,395 A 9/1998 Hamilton-Piercy et al. .. 455/4.1
5,825,762 A 10/1998 Kamin, Jr. et al. ..... 370/335
5,832,389 A 11/1998 Dent ..... 455/562
5,854,611 A 12/1998 Gans et al. ..... 342/373
5,856,804 A 1/1999 Turcotte et al. ..... 342/371
5,862,459 A 1/1999 Charas ..... 455/114
5,872,547 A 2/1999 Martek ..... 343/815
5,878,345 A 3/1999 Ray et al. ..... 455/431
5,880,701 A 3/1999 Bhame et al. ..... 343/890
5,884,147 A 3/1999 Reudink et al. ..... 455/67.1
5,889,494 A 3/1999 Reudink et al. ..... 342/373
5,929,823 A 7/1999 Martek et al. ..... 343/817
5,933,113 A 8/1999 Newberg et al. ..... 342/375
5,936,577 A 8/1999 Shoki et al. ..... 342/373
5,966,094 A 10/1999 Ward et al. ..... 342/373
5,969,689 A 10/1999 Martek et al. ..... 343/758
5,987,335 A 11/1999 Knoedl, Jr. et al. ..... 455/561
6,008,763 A 12/1999 Nyström et al. ..... 343/700 MS
6,016,123 A 1/2000 Barton et al. ..... 342/373
6,018,643 A 1/2000 Golemon et al. ..... 455/63
6,020,848 A 2/2000 Wallace et al. ..... 342/362
6,037,903 A 3/2000 Lange et al. ..... 343/700 MS
6,043,790 A 3/2000 Derneryd et al. ..... 343/853
6,047,199 A 4/2000 DeMarco ..... 455/572
6,055,230 A 4/2000 Feuerstein et al. ..... 370/335
6,070,090 A 5/2000 Feuerstein ..... 455/561
6,072,434 A 6/2000 Papatheodorou ..... 343/700 MS
6,091,360 A 7/2000 Reits ..... 342/368
6,094,165 A 7/2000 Smith ..... 342/373
6,104,935 A 8/2000 Smith et al. ..... 455/562
6,140,976 A 10/2000 Locke et al. ..... 343/853
6,144,652 A 11/2000 Avidor et al. ..... 370/336
6,157,343 A 12/2000 Andersson et al. ..... 342/371
6,160,514 A 12/2000 Judd ..... 343/700 MS
6,181,276 B1 1/2001 Schlekewey et al. ..... 342/372
6,188,373 B1 2/2001 Martek ..... 343/893
6,195,556 B1 2/2001 Reudink et al. ..... 455/456
6,198,434 B1 3/2001 Martek et al. ..... 342/373
6,198,435 B1 3/2001 Reudink et al. ..... 342/373
6,198,460 B1 3/2001 Brankovic ..... 343/879
6,222,503 B1 4/2001 Gietema et al. ..... 343/890
6,233,466 B1 5/2001 Wong et al. ..... 455/562
6,236,849 B1 5/2001 Reudink et al. ..... 455/342
6,240,274 B1 5/2001 Izadpanah ..... 455/39
6,246,674 B1 6/2001 Feuerstein et al. ..... 370/334
6,269,255 B1 7/2001 Waylett ..... 455/562
6,317,100 B1 * 11/2001 Elson et al. ..... 343/853
6,377,558 B1 4/2002 Dent ..... 370/321
2003/0064729 A1 * 4/2003 Yamashita ..... 455/451
2003/0092402 A1 * 5/2003 Shapira et al. ..... 455/101
2003/0153322 A1 * 8/2003 Burke et al. ..... 455/450

* cited by examiner

ACTIVE ANTENNA WITH INTERLEAVED ARRAYS OF ANTENNA ELEMENTS

FIELD OF THE INVENTION

This invention relates generally to antennas, and more particularly to antennas incorporating arrays of antenna elements.

BACKGROUND OF THE INVENTION

As the data rate in a digitally modulated wireless communication system is increased, a corresponding increase in the output power of the signals radiated by a tower-mounted antenna is typically required to effectively communicate with subscribers within a given service area. Thus, migrating an existing system to a higher data rate often requires more output power from the amplifiers used in the system and/or a reduction or elimination of losses associated with components in the system. However, it has been found that certain known modulation schemes may be better suited for migrating to higher data rates than others as the ability to increase output power differs for various modulation schemes.

For example, in systems using code-division multiple access (CDMA or WCDMA) modulation, a single multi-carrier amplifier may be used for several different carriers. In order to provide the additional radiated output power associated with higher data rates, a single, large multi-carrier amplifier is used in the system. Thus, a multi-carrier amplifier allows the task of amplifying the broad frequency spectrum associated with several carriers using a single, high power linear amplifier. As a result, multi-carrier amplifiers configured for use in CDMA systems may be capable of providing the additional radiated output power associated with higher data rates.

In other environments, comparable results may be obtained through a reduction of losses. For example, in systems using time-division multiple access (TDMA) modulation, a tunable cavity combiner, which typically has a relatively low insertion loss, may often be used to reduce losses, thereby requiring less gain from any amplifiers used therewith, and possibly providing the additional radiated output power associated with a higher data rates and multiple carriers.

Other modulation schemes, however, are not as well suited to increasing output power and carriers merely through the use of additional amplifiers dedicated to individual carriers or low insertion loss combiners. For example, unlike CDMA and TDMA systems, Global System for Mobile (GSM) communications systems use frequency hopping techniques to minimize interference between adjacent channels. Thus, unlike in a CDMA or TDMA system, the active carriers in GSM system may dynamically change from time to time, a process commonly referred to as frequency hopping. Therefore, amplifiers and combiners used with a GSM system may require greater bandwidth than those used in a CDMA or TDMA system to allow for frequency hopping.

Due to the requirement of greater bandwidth, multi-carrier power amplifiers and tuned cavity combiners are not as well suited for use in GSM systems. In particular, constructing a multi-carrier amplifier wherein each amplifier is capable of uniformly amplifying the bandwidth associated with frequency hopping in a GSM system can be expensive. Similarly, constructing a wide bandwidth tuned cavity combiner with low insertion loss across the band is difficult since the cavity is often optimized for a particular frequency to achieve low insertion loss. As a result, GSM systems often use hybrid combining due to bandwidth considerations associated with frequency hopping. However, a power loss of 3 dB is typically associated with hybrid combining, requiring even more gain and output power from amplifiers used therewith.

Recently, a new modulation technique was released for GSM communications referred to as Enhanced Data rates for Global Evolution, or EDGE. EDGE allows network operators to use existing GSM infrastructure to provide data, multimedia, and application services at rates of up to 384 kilobits per second (kbps), more than three times the speed of GSM. A difficulty encountered using existing GSM infrastructure to provide EDGE services is that EDGE modulation requires an additional 3–4 decibels (dB) more radiated power output than typical GSM systems.

In order to provide the additional gain necessary in providing higher data rates services, such as EDGE, some network operators have recognized the losses associated with hybrid combining and have resorted to using GSM multi-carrier power amplifiers. However, multi-carrier power amplifiers for such systems may be prohibitively expensive for some service providers in adapting their systems to high data rate modulation schemes, such as EDGE.

Thus, there is a need for an economical alternative that allows network operators to provide higher data rate services, such as EDGE, by affording additional gain and power through avoiding the losses associated with combiners typically used in such systems, and without resorting to using expensive multi-carrier amplifiers.

BRIEF DESCRIPTION OF THE DRAWINGS

The accompanying drawings, which are incorporated in and constitute part of this specification, illustrate embodiments of the invention and, together with the detailed description given below, serve to explain the principles of the invention.

DETAILED DESCRIPTION OF THE DRAWINGS

The present invention provides an economical alternative that allows network operators to provide higher data rate services, such as EDGE, by avoiding the losses associated with combiners typically used in telecommunication systems, and without resorting to expensive multi-carrier amplifiers. To this end, and in accordance with principles of the present invention, free space combining is used to provide the additional radiated output power desired with higher data rates.

Figure 1:
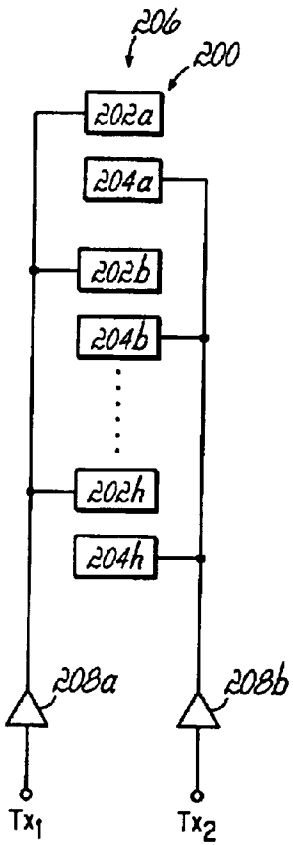
FIG. 1 is a block diagram of an antenna configured for free space combining in accordance with principles of the present invention.

With reference to FIG. 1, there is shown a block diagram of an antenna 200 configured for free space combining in accordance with principles of the present invention. Antenna 200 comprises a first array of radiating elements 202*a–h* interleaved with a second array of radiating elements 204*a–h* and arranged in a column 206, each array of elements advantageously coupled to a respective amplifier 208*a*, 208*b*. As illustrated, radiating elements 202*a–h*, 204*a–h* are patch elements; however, those skilled in the art will appreciate that other types of elements, such as dipoles, cavity backed patches, etc., may be used without departing from the spirit of the present invention.

In operation, radiation from the first array of elements 202*a–h* combines with radiation from the second array of elements distant from column 206, or in free space. Thus, power radiated from the column 206 is the sum of the power from amplifiers 208*a*, 208*b* without any associated combining losses.

Embodiments of the present invention may advantageously include an array or column having duplexed transmit and receive channels. Further, embodiments of the present invention may also include multiple columns, with some or all of such columns including duplexed transmit and receive channels, and optionally configured to provide receive diversity. Embodiments of the present invention may also include one or more columns dedicated to receiving signals. Further, a column may be configured for three or more channels using additional interleaving. Moreover, channels within a column or columns may have differing numbers of radiating elements without departing from the spirit of the present invention.

FIGS. 2–5 further illustrate embodiments of the present invention containing several configurations for antennas having four transmit channels and one receive channel. As such, the embodiments of FIGS. 2–5 may resemble embodiments configured for migrating an existing GSM system to EDGE. Those skilled in the art will appreciate that other embodiments having differing numbers of transmit and receive channels, columns and/or interleaving of arrays are possible for present or future telecommunication systems having the same or other modulation schemes without departing form the spirit of the present invention.

Figure 2:
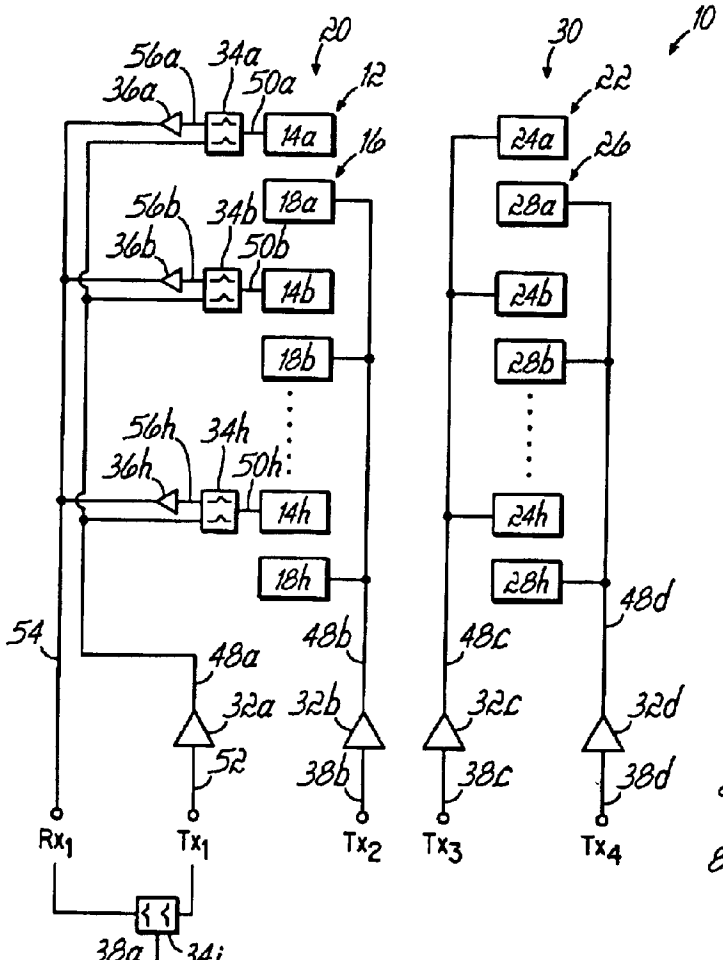
FIG. 2 is schematic diagram of a second embodiment of an antenna in accordance with principles of the present invention.

Referring to FIG. 2, there is shown a second embodiment 10 of an antenna in accordance with the principles of the present invention. Antenna 10 is configured to support four transmit channels and one receive channel, indicated at reference numerals $Tx_{1-4}$ and $Rx_1$, respectively. As configured in FIG. 2, antenna 10 provides four cables 38*a–d* for interconnection. Antenna 10 is comprised of a first array 12 of radiating elements 14*a–h* interleaved with a second array 16 of radiating elements 18*a–h* arranged in a column 20. Antenna 10 further comprises a third array 22 of radiating elements 24*a–h* interleaved with a fourth array 26 of radiating elements 28*a–h* arranged in a column 30. Antenna 10 further comprises a plurality of single channel amplifiers 32*a–d*, a plurality of duplexers 34*a–i*, and a plurality of low noise amplifiers 36*a–h*.

As illustrated, transmit channel $Tx_1$ is defined by the electrical connection of cable 38*a*, duplexer 34*i*, cable 52, single channel power amplifier 32*a*, feed 48*a*, duplexers 34*a–h*, cables 50*a–h*, and radiating elements 14*a–h*. Conversely, as also illustrated, receive channel $Rx_1$ is defined by the electrical connection of radiating elements 14*a–h*, cables 50*a–h*, duplexers 34*a–h*, cables 56*a–h*, low noise amplifiers 36*a–h*, feed 54, duplexer 34*i*, and cable 38. The receive channel $Rx_1$ is configured as a distributed active receive antenna (DARA) by including low noise amplifiers 36*a–h* proximate elements 14*a–h*, respectively. Similarly, transmit channel $Tx_2$ is defined by the electrical connection of cable 38*b*, single channel power amplifier 32*b*, feed 48*b*, and radiating elements 18*a–h*.

Transmit channel $Tx_3$ is defined by the electrical connection of cable 38*c*, single channel power amplifier 32*c*, feed 48*c*, and radiating elements 24*a–h*. Likewise, transmit channel $Tx_4$ is defined by the electrical connection of cable 38*d*, single channel power amplifier 32*d*, feed 48*d*, and radiating elements 28*a–h*.

In operation, the radiation of elements 14*a–h*, consistent with transmit channel $Tx_1$, and the radiation of elements 18*a–h*, consistent with transmit channel $Tx_2$, combine at a distance from antenna 10 due to interleaving of the radiating elements 14*a–h*, 18*a–h* in arrays 12, 16 in column 20. In like manner, the radiation of elements 24*a–h*, consistent with transmit channel $Tx_3$, and the radiation of elements 28*a–h*, consistent with transmit channel Tx4, also combine at a distance from antenna 10 due to interleaving of the radiating elements 24*a–h*, 28*a–h* in arrays 22, 26 in column 30.

It is contemplated that two such antennas 10 wherein the radiating elements 14*a–h*, 18*a–h*, 24*a–h*, 28*a–h* are linearly polarized, as understood by one skilled in the art, be used per sector in migrating a GSM system, desiring four connections per antenna 10 to EDGE.

Figure 3:
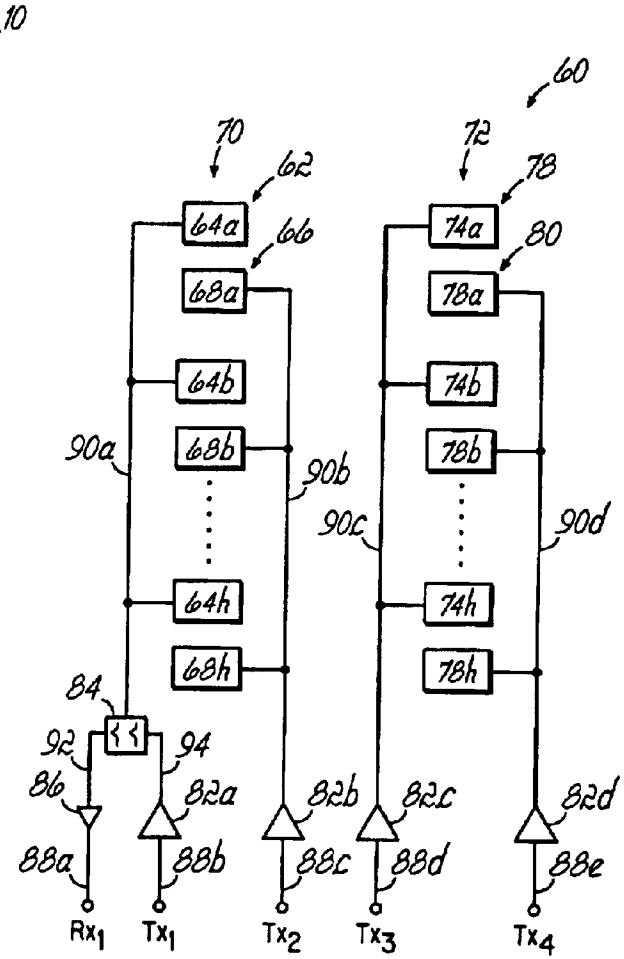
FIG. 3 is a schematic diagram of a third embodiment of an antenna in accordance with principles of the present invention.

Referring now to FIG. 3, a third embodiment of an antenna 60 in accordance with the principles of the present invention is illustrated. Antenna 60 also supports four transmit channels and one receive channel, indicated at reference numerals $Tx_{1-4}$ and $Rx_1$. Antenna 60 provides five cables 88*a–e* for interconnection. Antenna 60 comprises a first array 62 of radiating elements 64*a–h* and a second array 66 of radiating elements 68*a–h*. The radiating elements 64*a–h*, 68*a–h* of the arrays 62, 66 are alternately positioned within a first column 70.

Antenna 60 further comprises a second column 72 of alternately positioned radiating elements 74*a–h*, 76*a–h*. Radiating elements 74*a–h* are electrically connected as a third array 78. Radiating elements 76*a–h* are electrically connected as a fourth array 80.

Antenna 60 also comprises a plurality of cables 88*a–e*, 92, 94, a plurality of single channel amplifiers 82*a–d*, a duplexer 84, a low noise amplifier 86, and a plurality of feed networks 90*a–d*.

In this embodiment 60, receive channel $Rx_1$ is defined by the electrical connection of radiating elements 64*a-h*, feed network 90*a*, duplexer 84, cable 92, low noise amplifier 86, and cable 88*a*. Transmit channel $Tx_1$ is defined by the electrical connection of cable 88*b*, single channel power amplifier 82*a*, cable 94, duplexer 84, feed network 90*a*, and radiating elements 64*a–h*. Transmit channel $Tx_2$ is defined by the electrical connection of cable 88*c*, single channel power amplifier 82*b*, feed network 90*b*, and radiating elements 68*a-h*. Transmit channel $Tx_3$ is defined by the electrical connection of cable 88*d*, single channel power amplifier 82*c*, feed network 90*c*, and radiating elements 74*a–h*. $Tx_4$ is defined by the electrical connection of cable 88*e*, single channel power amplifier 82*d*, feed network 90*d*, and radiating elements 76*a–h*.

In operation, the radiation of elements 64*a–h* and elements 68*a–h* combine at a distance from antenna 60 due to the alternate positioning within first column 70. The radiation of elements 74*a–h* and elements 76*a–h* also combine at a distance from antenna 60 due to alternate positioning within column 72.

Two such antennas 60 wherein the radiating elements 64*a–h*, 68*a–h*, 74*a–h*, 76*a–h* are linearly polarized may be used per sector in migrating a GSM system, desiring five connections per antenna 60, to EDGE, as appreciated by one skilled in the art.

Figure 4:
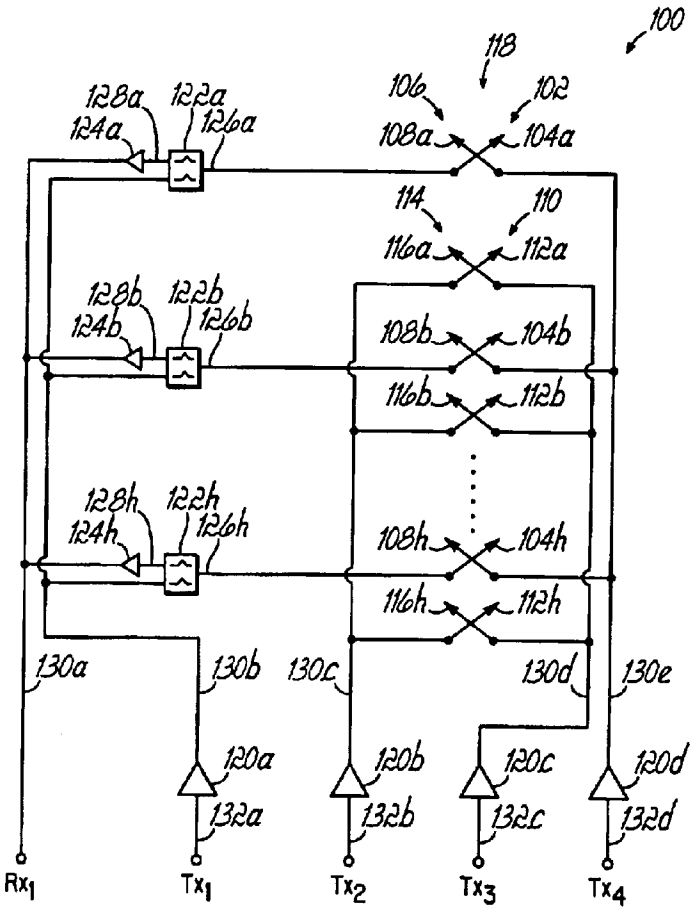
FIG. 4 is a schematic diagram of a fourth embodiment of an antenna in accordance with principles of the present invention.

Referring to FIG. 4, a fourth embodiment of an antenna 100 having dual slant polarized elements, DARA, and five connections consistent with the present invention is presented. It is contemplated that one such antenna 100 may be used per sector in migrating a GSM system to EDGE, as will be appreciated by one skilled in the art.

Antenna 100 comprises a first array 102 of radiating elements 104*a–h*, a second array 106 of radiating elements 108*a–h*, a third array 110 of radiating elements 112*a–h*, and fourth array 114 of radiating elements 116*a–h* arranged in a column 118. Radiating elements 104*a–h*, oriented at 45 degrees with respective to column 118, intersect perpendicularly and respectively with elements 108*a–h*, also oriented at 45 degrees with respective to column 118. Likewise, elements 12*a–h* intersect with elements 16*a–h*. Elements 104*a–h*, 108*a–h* are interleaved, or alternately positioned, with elements 112*a–h*, 116*a–h* in a column 118. Thus, dual slant polarization of antenna 110 is provided. Antenna 100 further comprises a plurality of single channel amplifiers 120*a-d*, a plurality of duplexers 122*a–h*, and a plurality of low noise amplifiers 124*a–h*.

In antenna 118, receive channel $Rx_1$ is defined by the electrical connection of radiating elements 104*a–h*, cables 126*a–h*, duplexers 122*a–h*, cables 128*a–h*, low noise amplifiers 124*a–h*, and feed 130. The receive channel $Rx_1$ is configured as a distributed active receive antenna (DARA) by providing a low noise amplifiers 124*a–h* for each element 104*a–h*.

Transmit channel $Tx_1$ is defined by the electrical connection of cable 132*a*, single channel power amplifier 120*a*, feed 130*b*, duplexers 122*a–h*, cables 126*a–h*, and radiating elements 104*a–h*. Transmit channel $Tx_2$ is defined by the electrical connection of cable 132*b*, single channel power amplifier 120*b*, feed 130*c*, and radiating elements 112*a–h*.

Transmit channel $Tx_3$ is defined by the electrical connection of cable 132*c*, single channel power amplifier 120*c*, feed 130*d*, and radiating elements 116*a–h*. Similarly, transmit channel $Tx_4$ is defined by the electrical connection of cable 132*d*, single channel power amplifier 120*d*, feed 130*e*, and radiating elements 108*a–h*.

In operation, the cross polarized radiation of elements 104*a–h*, consistent with transmit channel $Tx_1$, and elements 108*a–h*, consistent with transmit channel $Tx_4$, combine with the cross polarized radiation of elements 112*a–h*, consistent with transmit channel $Tx_2$, and elements 116*a–h*, consistent with $Tx_3$, at a distance from antenna 118 due to interleaving of the radiating elements 14*a–h*, 18*a–h* in arrays 12, 16 in column 20. In like manner, the radiation of elements 24*a–h*, consistent with transmit channel $Tx_3$, and the radiation of elements 28*a–h*, consistent with transmit channel $Tx_4$, also combine at a distance from antenna 100 due to interleaving, or alternate positioning, of elements 104*a–h*, 108*a–h* and elements 112*a–h*, 116*a–h* in a column 118.

Figure 5:
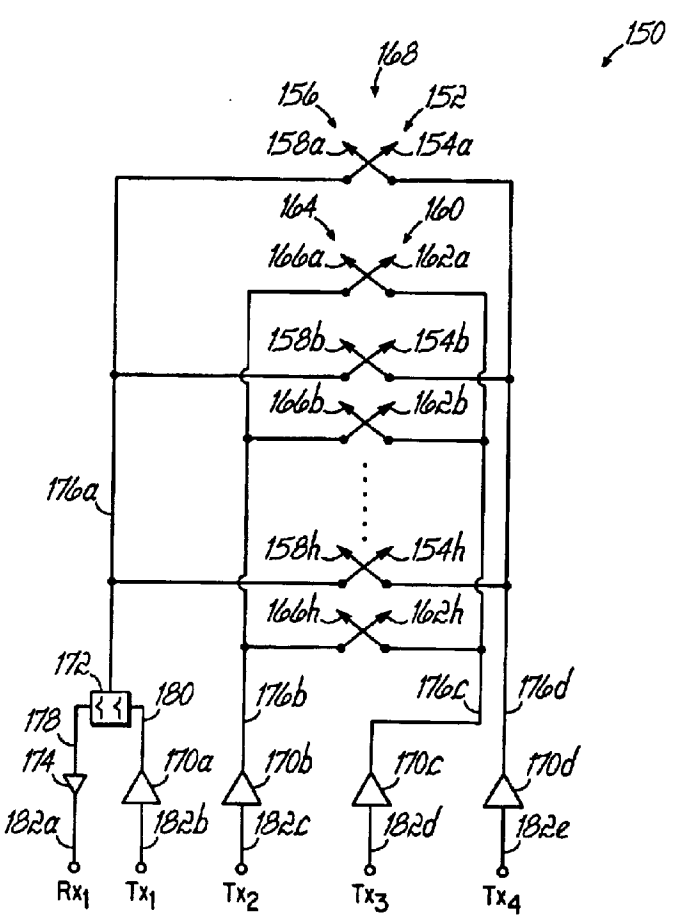
FIG. 5 is a schematic diagram of a fifth embodiment of an antenna in accordance with principles of the present invention.

Referring now to FIG. 5, a fifth embodiment of an antenna 150 having dual slant polarized elements and five connections consistent with the present invention is presented. Antenna 150 may be used for a sector in migrating a GSM system to EDGE, as will be appreciated by one skilled in the art.

Antenna 150 comprises a first array 152 of radiating elements 154*a–h*, a second array 156 of radiating elements 158*a–h*, a third array 160 of radiating elements 162*a–h*, and fourth array 164 of radiating elements 166*a–h* arranged in a column 168.

Radiating elements 154*a–h*, oriented at 45 degrees with respective to column 168, intersect perpendicularly and respectively with elements 158*a–h*, also oriented at 45 degrees with respective to column 168. Elements 162*a–h* intersect with elements 166*a–h*, with respect to column 168, in a like manner. Elements 154*a–h*, 158*a–h* are interleaved, or alternately positioned, with elements 162*a–h*, 166*a–h* in a column 168. Thus, antenna 150 has dual slant polarization.

Antenna 150 further comprises a plurality of single channel amplifiers 170*a-d*, a duplexer 172, and a low noise amplifier 174. In antenna 158, receive channel $Rx_1$ is defined by elements 154*a–h*, duplexer 172, and low noise amplifier 174 interconnected by feed network 176, cables 178, 182*a*.

Transmit channel $Tx_1$ is defined by single channel power amplifier 170*a*, duplexers 172, and radiating elements 154*a–h* interconnected by cables 182*b*, 180 and feed network 176*a*. Transmit channel $Tx_2$ is defined the electrical connection of cable 182*c*, single channel power amplifier 170*b*, feed network 176*b*, and radiating elements 162*a–h*. Transmit channel $Tx_3$ is defined by the electrical connection of cable 182*d*, single channel power amplifier 170*c*, feed network 176*c*, and radiating elements 166*a–h*. Similarly, transmit channel $TX_4$ is defined by the electrical connection of cable 182*e*, single channel power amplifier 170*d*, feed network 176*d*, and radiating elements 158*a–h*.

In operation, the cross polarized radiation of elements 154*a–h*, consistent with transmit channel $Tx_1$, and elements 158*a–h*, consistent with transmit channel $Tx_4$, combine with the cross polarized radiation of elements 162*a–h*, consistent with transmit channel $Tx_2$, and elements 166*a–h*, consistent with $Tx_3$, at a distance from antenna 150 due to interleaving of the radiating elements 154*a–h*, 158*a–h* in arrays 152, 156 and elements 162*a–h*, 166*a–h* in column 168.

By virtue of the foregoing, there is thus provided an antenna that avoids the losses associated with combiners typically found in telecommunication systems. Such an antenna employs the principles of combining the radiation of interleaved elements in antenna arrays at a distance, far field, or in free space from the antenna. Such an antenna may also include single channel amplifiers.

While the present invention has been illustrated by the description of embodiments thereof, and while the embodiments have been described in considerable detail, it is not the intention of applicants to restrict or in any way limit the scope of the appended claims to such detail. Additional advantages and modifications will readily appear to those skilled in the art. It will be understood that the electrical connect to, from and between components such as low noise amplifiers, single channel power amplifiers, duplexers, and radiating elements may be accomplished using methods other than feeds, feed networks, or cables. Other methods include, but are not limited to: stripline, microstrip, hardlines, and etchings on circuit boards. It will also be understood that embodiments of the present invention are not limited to arrays of eight radiating elements. Rather, any number of interleaved or alternately positioned radiating elements may be used. Further, embodiments of the present invention are not limited to one receive channel and four transmit channels. An embodiment of the present invention could be constructed using any number of receive and transmit channels using the principles described herein. The invention in its broader aspects is therefore not limited to the specific details, representative apparatus and method, and illustrative examples shown and described. Accordingly, departures may be made from such details without departing from the spirit or scope of applicants' general inventive concept.

What is claimed is:

1. An antenna comprising:

a first array of radiating elements;

a second array of radiating elements;

a first power amplifier electrically coupled to the first array;

a second power amplifier electrically coupled to the second array;

wherein the radiating elements of the first array and the first amplifier define a first transmit channel, the radiating elements of the second array and the second amplifier define a second transmit channel, and the elements of the first array are interleaved with the radiating elements of the second array in a column so that radiation from the first array, associated with the first transmit channel, combines with radiation from the second array, associated with the second transmit channel, at a distance from the antenna.

2. The antenna of claim 1, wherein the elements are linearly polarized.

3. The antenna of claim 1, further comprising:

a duplexer coupled intermediate the first amplifier and at least one of the elements in the first array;

a low noise amplifier coupled to the duplexer;

wherein the first array of radiating elements, the duplexer, and the low noise amplifier define a receive channel.

4. The antenna of claim 3, further comprising:

a third array of radiating elements;

a fourth array of radiating elements;

a third power amplifier electrically coupled to the third array;

a fourth power amplifier electrically coupled to the fourth array;

wherein the radiating elements of the third array and the third amplifier define a third transmit channel, the radiating elements of the fourth array and the fourth amplifier define a fourth transmit channel, and the elements of the third array are interleaved with the radiating elements of the fourth array in a second column so that radiation from the third array, associated with the third transmit channel, combines with radiation from the fourth array, associated with the fourth transmit channel, at a distance from the antenna.

5. The antenna of claim 1, further comprising:

a third array of radiating elements;

a fourth array of radiating elements;

a third power amplifier electrically coupled to the third array;

a fourth power amplifier electrically coupled to the fourth array;

wherein the radiating elements of the third array and the third amplifier define a third transmit channel, the radiating elements of the fourth array and the fourth amplifier define a fourth transmit channel, and the elements of the third array intersect substantially orthogonally and respectively with elements of the first array and the elements of the fourth array intersect substantially orthogonally and respectively with elements of the second array.

6. The antenna of claim 1, further comprising:

a plurality of low noise amplifiers, each low noise amplifier located proximate an element in the first array;

a plurality of duplexers, each duplexer coupled intermediate an element in the first array and a low noise amplifier;

wherein the first array of radiating elements, the plurality of duplexers, and the plurality of low noise amplifiers define a distributed active receive antenna.

7. The antenna of claim 1, further comprising:

a duplexer coupled intermediate the first amplifier and the first array;

a low noise amplifier coupled to the duplexer;

wherein the first array, the duplexer, and the low noise amplifier define a receive channel.

8. The antenna of claim 1, wherein the radiating elements are patch elements.

9. The antenna of claim 1, wherein the radiating elements are dipole elements.

10. The antenna of claim 1, where in the amplifiers are single channel amplifiers.

11. An antenna comprising:

a first array of radiating elements;

a second array of radiating elements;

a third array of radiating elements;

a fourth array of radiating elements;

a first power amplifier electrically coupled to the first array;

a second power amplifier electrically coupled to the second array;

a third power amplifier electrically coupled to the third array;

a fourth power amplifier electrically coupled to the fourth array;

wherein the radiating elements are arranged in a column;

wherein the elements of the first array intersect substantially orthogonally and respectively with elements of the second array;

wherein the elements of the third array intersect substantially orthogonally and respectively with elements of the fourth array; and, wherein the elements of the first and second arrays are interleaved with the elements of the third and fourth arrays so that radiation from the arrays forms dual slant polarization at a distance from the antenna.

12. The antenna of claim 11, wherein the first array and the first amplifier define a first transmit channel, the second array and the second amplifier define a second transmit channel, the third array and the third amplifier define a third transmit channel, and the fourth array and the fourth amplifier define a fourth transmit channel.

13. The antenna of claim 11, wherein the elements are dipole elements.

14. The antenna of claim 11, further comprising:

a duplexer, coupled intermediate the first amplifier and at least one of the elements in the first array;

a low noise amplifier coupled to the duplexer;

wherein the first array of radiating elements, the duplexer, and the low noise amplifier define a receive channel.

15. The antenna of claim 11, wherein the amplifiers are single channel amplifiers.

16. The antenna of claim 11, further comprising:

a plurality of low noise amplifiers, each low noise amplifier located proximate an element in the first array;

a plurality of duplexers, each duplexer coupled intermediate an element in the first array and a low noise amplifier;

wherein the first array of radiating elements, the plurality of duplexers, and the plurality of low noise amplifiers define a distributed active receive antenna.

17. The antenna of claim 11, further comprising:

a duplexer coupled intermediate the first amplifier and the first array;

a low noise amplifier couple to the duplexer;

wherein the first array, the duplexer, and the low noise amplifier define a a receive channel.

18. A method of transmitting a communications signal from an antenna comprising:

amplifying a first transmit signal using a first amplifier;

amplifying a second transmit signal using a second amplifier;

communicating the first transmit signal to a first array of radiating elements; and communicating the second transmit signal to a second array of radiating elements;

wherein the radiating elements of the first array are interleaved with the radiating elements of the second array in a column so that radiation from the first array combines with radiation from the second array at a distance from the antenna.

19. The method of claim 18, further comprising:

receiving a receive signal using the first array;

communicating the receive signal to a low noise amplifier;

amplifying the receive signal using the low noise amplifier.

20. The method of claim 18, further comprising:

amplifying a third transmit signal using a third amplifier;

amplifying a fourth transmit signal using a fourth amplifier;

communicating the third transmit signal to a third array of radiating elements;

communicating the fourth transmit signal to a fourth array of radiating elements;

wherein the radiating elements of the third array are interleaved with the radiating elements of the fourth array in a second column so that radiation from the third array combines with radiation from the fourth array at a distance from the antenna.

21. The antenna of claim 18, further comprising:

amplifying a third transmit signal using a third amplifier;

amplifying a fourth transmit array signal using a fourth amplifier;

communicating the third transmit signal to a third array of radiating elements;

communicating the fourth transmit signal to a fourth array of radiating elements;

wherein the radiating elements of the third array and the third amplifier define a third transmit channel, the radiating elements of the fourth array and the fourth amplifier define a fourth transmit channel, and the elements of the third array intersect substantially orthogonally and respectively with elements of the first array and the elements of the fourth array intersect substantially orthogonally and respectively with elements of the second array.

22. A method of transmitting a communications signal from an antenna comprising:

amplifying a first transmit signal using a first amplifier;

amplifying a second transmit signal using a second amplifier;

amplifying a third transmit signal using a third amplifier;

amplifying a fourth transmit array signal using a fourth amplifier;

communicating the first transmit signal to a first array of radiating elements;

communicating the second transmit signal to a second array of radiating elements;

communicating the third transmit signal to a third array of radiating elements;

communicating the fourth transmit signal to a fourth array of radiating elements;

wherein the radiating elements are arranged in a column;

wherein the elements of the first array intersect substantially orthogonally and respectively with elements of the second array;

wherein the elements of the third array intersect substantially orthogonally and respectively with elements of the fourth array; and, wherein the elements of the first and second arrays are interleaved with the elements of the third and fourth arrays so that radiation from the arrays forms dual slant polarization at a distance from the antenna.

* * * * *

UNITED STATES PATENT AND TRADEMARK OFFICE

CERTIFICATE OF CORRECTION

PATENT NO. : 6,844,863 B2 
DATED : January 18, 2005
INVENTOR(S) : Mano D. Judd and Thomas A. Bachman, II It is certified that error appears in the above-identified patent and that said Letters Patent is hereby corrected as shown below:

Title page,
Item [56], References Cited, OTHER PUBLICATIONS, first reference, please delete the name of author "Blalkowski" and replace it with -- Bialkowski --.

Column 1,
Line 43, please delete the word "a" after the word "with".

Column 2,
Line 42, please delete "invention," and replace it with -- invention. --
Line 43, please insert the word -- a -- between the words "is" and "schematic."

Column 4,
Line 17, please delete "Tx4" and replace it with -- $Tx_4$ --.

Column 5,
Lines 15 and 17, please delete "respective" and replace it with -- respect --.
Lines 17-18, please delete "elements 12*a-h* intersect with elements 16*a-h*." and replace it with -- elements 112*a-h* intersect with elements 116*a-h*. --.
Line 30, please delete "amplifiers" and replace it with -- amplifier --.

Column 6,
Lines 2 and 4, please delete "respective" and replace it with -- respect --.
Line 18, please insert the word -- by -- between the words "is" and "defined."
Line 24, please delete "$TX_4$" and replace it with -- $Tx_4$ --.

Column 8,
Line 14, please delete "where in" and replace it with -- wherein --.

UNITED STATES PATENT AND TRADEMARK OFFICE

CERTIFICATE OF CORRECTION

PATENT NO. : 6,844,863 B2
DATED : January 18, 2005
INVENTOR(S) : Mano D. Judd and Thomas A. Bachman, II It is certified that error appears in the above-identified patent and that said Letters Patent is hereby corrected as shown below:

Column 9,
Line 4, please delete “couple” and replace it with -- coupled --.

Signed and Sealed this

Twenty-eighth Day of June, 2005

JON W. DUDAS
*Director of the United States Patent and Trademark Office*